US007422055B2

(12) United States Patent
Cruickshank et al.

(10) Patent No.: US 7,422,055 B2
(45) Date of Patent: Sep. 9, 2008

(54) COILED TUBING WIRELINE CUTTER

(75) Inventors: Brian W. Cruickshank, The Woodlands, TX (US); Benjamin Bianchi, Montgomery, TX (US); Richard Messa, Lafayette, LA (US)

(73) Assignee: Smith International, Inc., Houston, TX (US)

( * ) Notice: Subject to any disclaimer, the term of this patent is extended or adjusted under 35 U.S.C. 154(b) by 271 days.

(21) Appl. No.: 11/179,882

(22) Filed: Jul. 12, 2005

(65) Prior Publication Data

US 2007/0012449 A1 Jan. 18, 2007

(51) Int. Cl.
*E21B 29/00* (2006.01)

(52) U.S. Cl. ..... 166/54.6; 166/54.5

(58) Field of Classification Search ..... 166/298, 166/55, 54.5, 376, 384, 385, 54.6, 173
See application file for complete search history.

(56) References Cited

U.S. PATENT DOCUMENTS 1,776,026 A * 9/1930 Hinderliter ..... 166/54.5
3,967,647 A * 7/1976 Young ..... 137/614.11
4,237,972 A * 12/1980 Lanmon, II ..... 166/54.5
4,512,411 A * 4/1985 Pringle ..... 166/54.5
4,738,312 A * 4/1988 Wittrisch ..... 166/54.5
7,086,467 B2 * 8/2006 Schlegelmilch et al. ..... 166/298

* cited by examiner

*Primary Examiner*—David Bagnell
*Assistant Examiner*—Brad Harcourt
(74) *Attorney, Agent, or Firm*—Conley Rose, P.C.

(57) ABSTRACT

A wireline cutter comprises a primary housing with a first axial bore configured to receive a wireline positioned within a well bore, and a first blade mounted within the primary housing and operable to cut the wireline. A method of cutting a wireline in a well bore comprises running a wireline cutter into the well bore, receiving the wireline within the wireline cutter, and cutting the wireline with the wireline cutter. A one-trip cutting system for use in a well bore comprises a wireline cutter, and a coiled tubing cutter. A method for cutting a coiled tubing with a wireline disposed therein comprises running a system comprising a wireline cutter and a coiled tubing cutter into the well bore, cutting the coiled tubing with the coiled tubing cutter, and cutting the wireline with the wireline cutter, wherein both cutting steps are performed in one trip into the well bore.

11 Claims, 7 Drawing Sheets

150
130
100
140
110
120
10
160
190
150
165
150
170
175
200
205
210

150
130
100
140
110
120
10
160
155
190
150
155
150
170
175
200
205
210

COILED TUBING WIRELINE CUTTER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to apparatus and methods for cutting a wireline or other umbilical disposed within a well bore. In one aspect, the present invention relates to a wireline cutter and methods of use. In another aspect, the present invention relates to one-trip systems and methods for cutting both a coiled tubing string and a wireline disposed therein when the coiled tubing and/or wireline breaks or becomes stuck within a well bore.

BACKGROUND

Historically, hydrocarbons such as oil and gas were produced by drilling a substantially vertical well bore from a surface location above the formation to the desired hydrocarbon zone at some depth below the surface. However, modern drilling technology and techniques allow for the drilling of well bores that deviate from vertical. Therefore, deviated well bores may be drilled from a convenient surface location to the desired hydrocarbon zone.

During such drilling or other well bore operations, it may be economically infeasible or otherwise undesirable to use jointed drill pipe. Therefore, apparatus and methods have been developed for performing such operations using coiled tubing, which is a single length of continuous, unjointed tubing spooled onto a reel for storage in sufficient quantities to exceed the length of the well bore. The coiled tubing may include one or more umbilicals disposed therein, such as a wireline to provide power and data communications to and from a drilling assembly, a hose for injecting chemicals into the well bore, or a heating string, for example.

When drilling a vertical well bore or a sidetracked well bore using a coiled tubing drill string, many circumstances can arise where it becomes necessary to cut the coiled tubing and remove it from the well bore. This may occur, for example, when the drilling assembly gets stuck during drilling, and the coiled tubing must be cut away from the drilling assembly to facilitate fishing, jarring, or other operations.

Under such circumstances, the coiled tubing that extends into the well bore, as well as any umbilicals installed therein, must be cut away from the coiled tubing reel at the surface and released into the well bore. Then, various apparatus and methods are available for cutting the coiled tubing drill string from the drilling assembly and retrieving it from the well bore. One such apparatus comprises a coiled tubing cutter, such as the Cutting Overshot device sold by Thru-Tubing Technology, Inc. of Scott, La. In operation, the Cutting Overshot device is attached to a work string and then lowered to receive the coiled tubing within a tubular housing of the device. When the Cutting Overshot device reaches the desired cutting location on the coiled tubing, the work string is raised to apply an upward force on the Cutting Overshot device, thereby shearing a plurality of set screws, and forcing a cutting grapple into the coiled tubing to cut the tubing. Although the Cutting Overshot device is very effective for cutting the coiled tubing drill string, it is not configured to cut a wireline or other umbilical running inside the coiled tubing. Therefore, at least a second trip into the well bore is required to retrieve and/or cut the wireline and other umbilicals.

There are other circumstances in which a wireline might be stuck within a coiled tubing string in a well bore. For example, a wireline may be used as a work string to lower a cutting device into the coiled tubing that is stuck in the well bore. However, if the wireline cutting device fails, and/or the wireline will not release, the wireline may break, thereby leaving both the stuck coiled tubing with the stuck wireline disposed therein in the well. Under this scenario, a first trip would be made to cut the coiled tubing, such as with the Cutting Overshot device described above, and then a second trip would be made to cut the wireline. Thus, a need exists for apparatus and methods to cut both a coiled tubing and a wireline disposed therein in one trip into the well bore.

There are also circumstances wherein a wireline not associated with a coiled tubing string may be stuck in a well bore, such as when conducting a wireline fishing operation to retrieve a drilling assembly or other downhole tool. In this type of operation, after the coiled tubing has been cut and retrieved from the well bore, a wireline work string is lowered into the well bore with a fishing device disposed at the lower end thereof for catching the drilling assembly or other tool that is stuck in the well bore. However, if the fishing device catches the fish, but the wireline cannot pull it loose, the wireline may break. Then another trip would be required to cut the wire and retrieve it.

Conventionally, fishing tools, such as a wire grab or a rope spear, for example, with barbs disposed on the end thereof, have been used to cut and/or retrieve a wireline that is either stuck in the well bore or simply disconnected from the surface. The fishing tool is run into the well bore past the upper end of the wireline, then rotated to wrap the tool around the wireline and grab the wireline with the barbs. The wireline may also be "bird nested" by pushing it down within the well bore before rotating the fishing tool to thereby tangle the wireline and make it easier to grab with the barbs. Once the wireline has been grabbed by the fishing tool, an upward force is exerted on the fishing tool to either retrieve an unstuck wireline or cut a stuck wireline. However, a need exists for apparatus and methods that will efficiently and effectively cut through a wireline within a well bore.

SUMMARY

In one aspect, the present disclosure relates to a wireline cutter comprising a primary housing with a first axial bore configured to receive a wireline positioned within a well bore, and a first blade mounted within the primary housing and operable to cut the wireline. The first blade may comprise teeth operable to grip and cut the wireline. In an embodiment, the wireline cutter further comprises a torsional spring, which biases the first blade to a closed position extending radially across the first axial bore. The first blade cuts the wireline in the closed position.

In another embodiment, the wireline cutter further comprises one or more modular housings, wherein each of the one or more modular housings comprises another axial bore configured to receive the wireline, and another blade mounted within the modular housing and operable to cut the wireline.

The wireline cutter may further comprise a plurality of set screw sockets disposed in a wall of the primary housing, and a plurality of set screw bores disposed in a wall of each of the one or more modular housings, wherein the set screw sockets are spaced apart circumferentially, and wherein the set screw bores are spaced apart circumferentially to correspond with the spacing of the set screw sockets. The set screw cavities and the set screw bores enable rotational adjustability when connecting the primary housing and a modular housing. In an embodiment, the wireline cutter further comprises a plurality of set screw cavities disposed in the wall of each of the one or more modular housings. The set screw cavities and the set screw bores in each of the modular housings enable rotational adjustability when connecting two modular housings. In another embodiment, the primary housing is further configured to receive an umbilical positioned within the well bore, and the first blade is operable to cut the umbilical.

In another aspect, the present disclosure relates to a method of cutting a wireline in a well bore comprising running a wireline cutter into the well bore, receiving the wireline within the wireline cutter, and cutting the wireline with the wireline cutter. The method may further comprise pushing the wireline against an internal wall of the wireline cutter. In an embodiment, the cutting step comprises actuating at least one blade of the wireline cutter. The actuating step may comprise moving the at least one blade into engagement with the wireline, gripping the wireline with the at least one blade, and exerting a force on the at least one blade sufficient to cut the wireline. In an embodiment, the cutting step comprises actuating a plurality of blades spaced apart axially along the wireline cutter, and the method may further comprise circumferentially aligning the plurality of blades, or circumferentially staggering the plurality of blades at different angles.

In yet another aspect, the present disclosure relates to a one-trip cutting system for use in a well bore comprising a wireline cutter, and a coiled tubing cutter.

In still another aspect, the present disclosure relates to a method for cutting, within a well bore, a coiled tubing with a wireline disposed therein comprising running a system comprising a wireline cutter and a coiled tubing cutter into the well bore, cutting the coiled tubing with the coiled tubing cutter, and cutting the wireline with the wireline cutter, wherein both cutting steps are performed in one trip into the well bore. In an embodiment, the method further comprises extending the coiled tubing into the wireline cutter, pushing a blade of the wireline cutter to an open position using the coiled tubing, removing the coiled tubing from engagement with the blade, exposing the wireline, and moving the blade into a wireline cutting position.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the present invention, reference will now be made to the accompanying drawings, wherein.

NOTATION AND NOMENCLATURE

Figure 1:
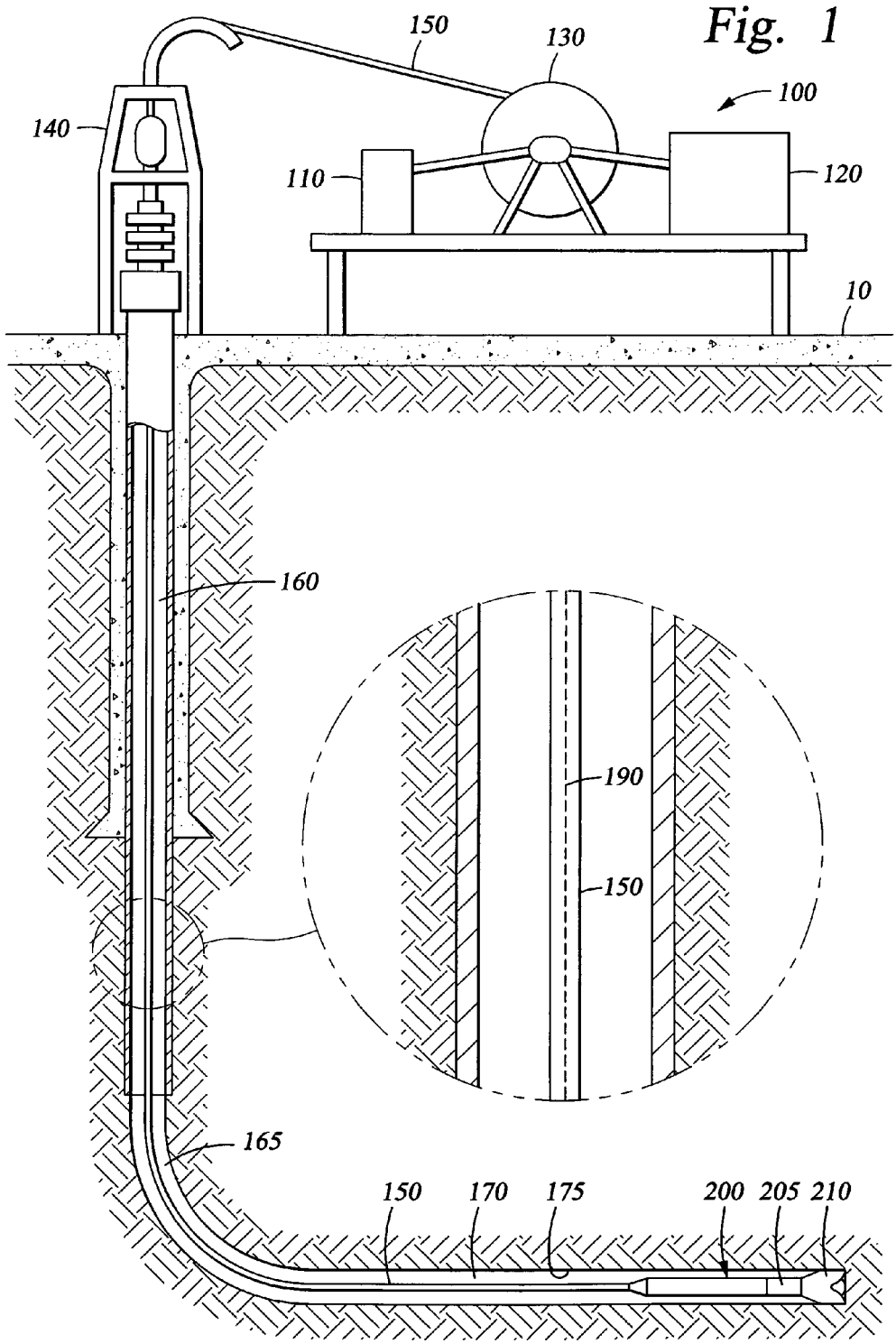
FIG. 1 is a schematic view, partially in cross-section, of a representative operational environment, depicting a coiled tubing drilling assembly drilling a deviated well bore.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . "

Reference to up or down will be made for purposes of description with "up", "upper", or "upstream" meaning toward the earth's surface or toward the entrance of a well bore; and "down", "lower", or "downstream" meaning toward the bottom or terminal end of a well bore.

In the drawings, the cross-sectional and elevational side views of the wireline cutter should be viewed from left to right, with the upstream end at the left of the drawing and the downstream end at the right of the drawing.

DETAILED DESCRIPTION

Various embodiments of methods and apparatus for cutting coiled tubing and a wireline (or other umbilical) disposed therein in one trip into the well bore, and various embodiments of a wireline cutter, will now be described with reference to the accompanying drawings, wherein like reference numerals are used for like features throughout the several views. There are shown in the drawings, and herein will be described in detail, specific embodiments of one-trip coiled tubing and wireline cutter systems, as well as wireline cutters, with the understanding that this disclosure is representative only, and is not intended to limit the invention to those embodiments illustrated and described herein. The embodiments of the apparatus disclosed herein may be utilized in any type of coiled tubing and wireline operation. It is to be fully recognized that the different teachings of the embodiments disclosed herein may be employed separately or in any suitable combination to produce desired results.

FIG. 1 depicts one representative coiled tubing well bore operation comprising a coiled tubing system 100 on the surface 10 and a drilling assembly 200 shown drilling a subsurface deviated well bore 170. The coiled tubing system 100 includes a power supply 110, a surface processor 120, and a coiled tubing spool 130. An injector head unit 140 feeds and directs the coiled tubing 150 from the spool 130 into the primary well 160. A wireline 190 may be installed inside the coiled tubing 150 to provide power and/or communications to the drilling assembly 200 during operation. Therefore, the power supply 110 and/or the surface processor 120 may be connected to a wireline 190 that extends through the coiled tubing 150, as shown in the enlarged portion of FIG. 1. Alternatively, a hose or other umbilical could be run in place of, or in addition to, the wireline 190.

The drilling assembly 200, which includes a drilling motor 205 and a drill bit 210, connects to the lower end of the coiled tubing 150 and extends into the deviated well bore 170 being drilled. The drilling motor 205 operates the drill bit 210, which cuts into the deviated well bore wall 175. The drilling motor 205 is powered by drilling fluid pumped from the surface 10 through the coiled tubing 150. The drilling fluid flows out through the drill bit 210, and into the well bore annulus 165 back up to the surface 10.

Figure 2:
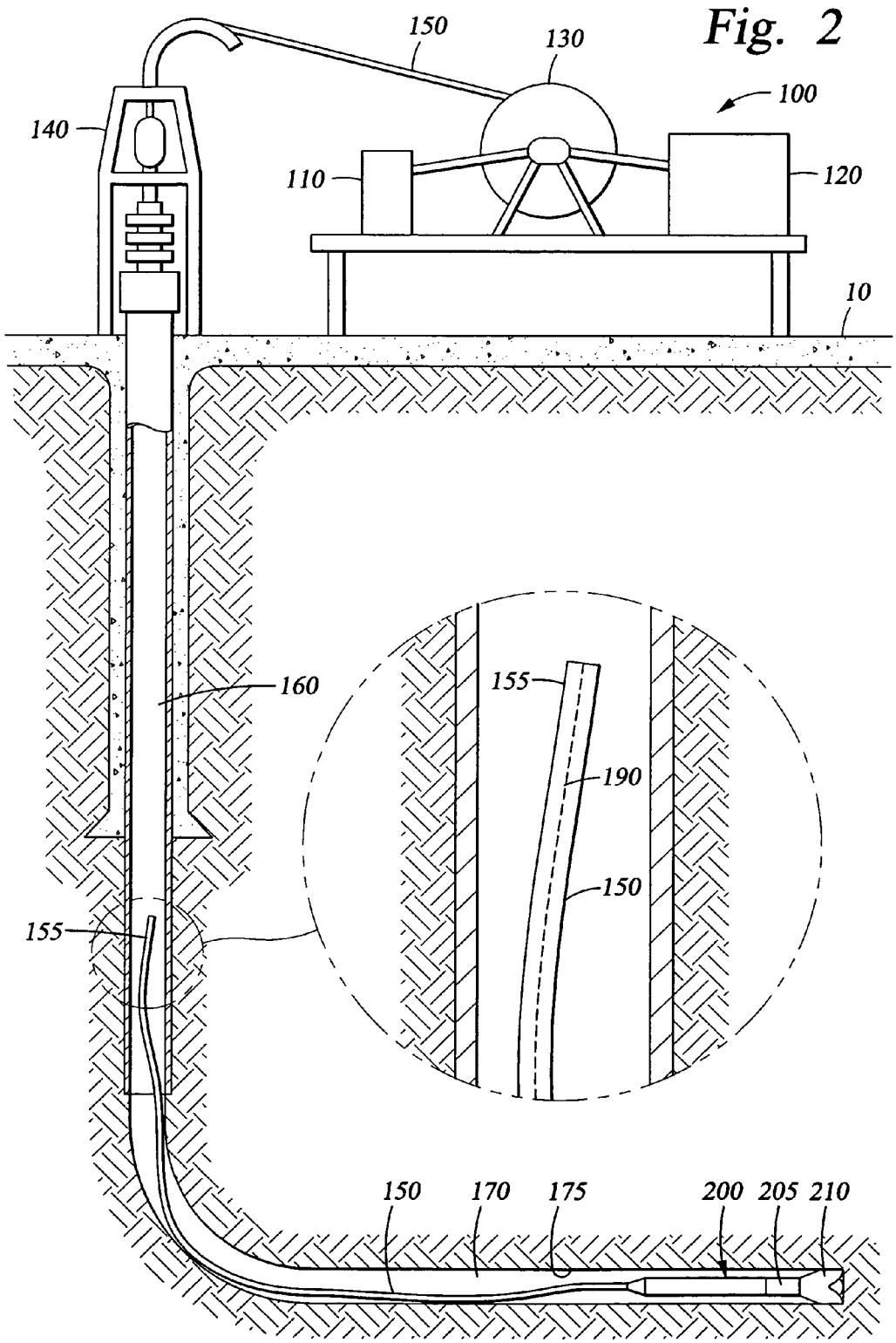
FIG. 2 is a schematic view, partially in cross-section, depicting the drilling assembly of FIG. 1 stuck in the deviated well bore, and attached to a portion of coiled tubing drill string that has been cut away from the coiled tubing reel at the surface.

As drilling progresses, it is not uncommon for the drilling assembly 200 and/or the coiled tubing 150 to become stuck within the deviated well bore 170, as schematically depicted in FIG. 2. Under such circumstances, the drilling assembly 200 must be fished out of the well 160, which may require that the coiled tubing 150 and wireline 190 be cut away from the drilling assembly 200. FIG. 2 schematically depicts a portion 155 of coiled tubing 150 that remains connected to the drilling assembly 200 in the well 160 after the coiled tubing 150 drill string has been cut away from the reel 130 at the surface 10.

Figure 3:
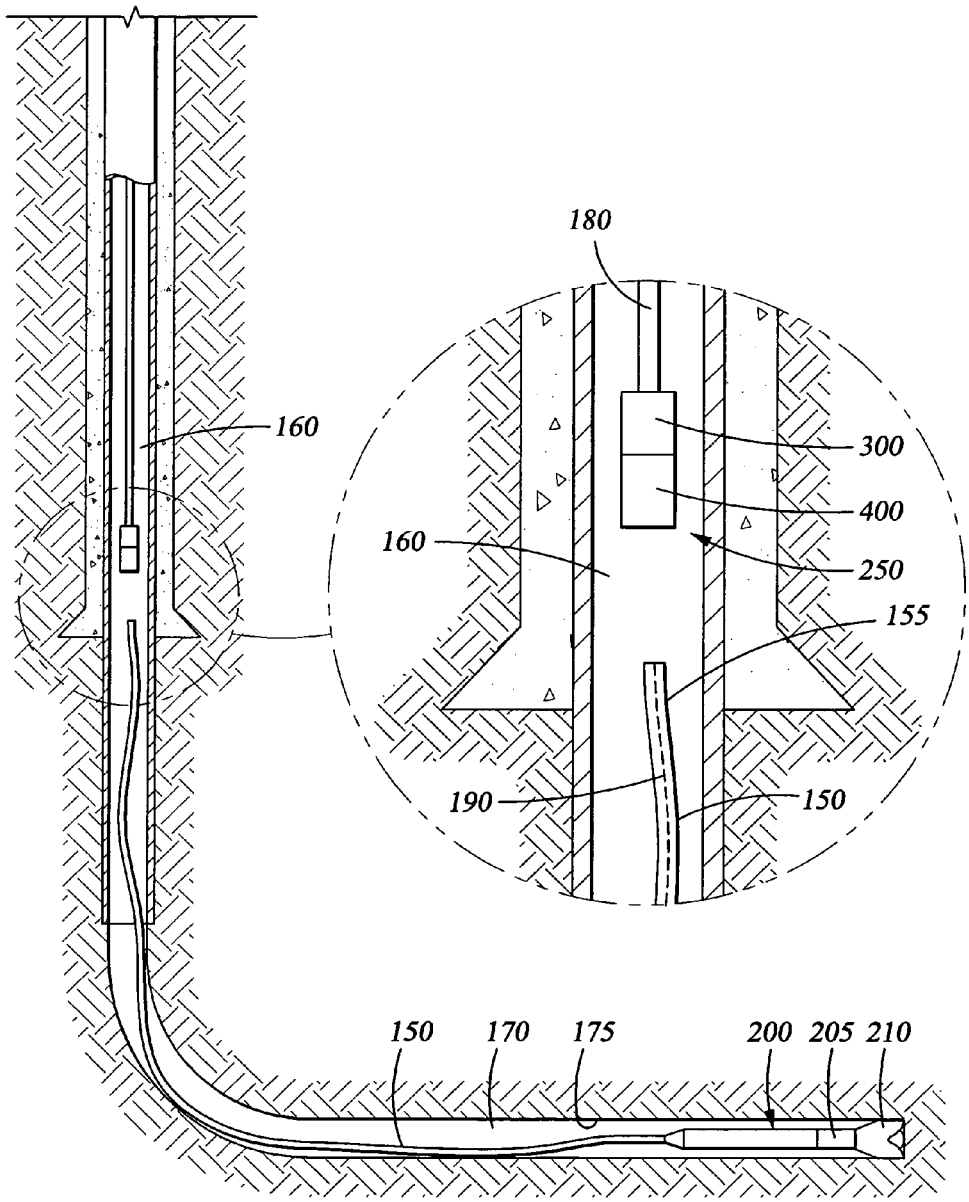
FIG. 3 is a schematic view, partially in cross-section, depicting one embodiment of a one-trip cutting system comprising a wireline cutter and a coiled tubing cutter being lowered toward the coiled tubing stuck in the well bore.

FIG. 3 schematically depicts one embodiment of a one-trip cutting system 250 of the present invention as it is being lowered into the well 160 on a work string 180, such as jointed pipe, for example, toward the portion 155 of coiled tubing 150 and wireline 190 that will be cut away from the drilling assembly 200 and retrieved to the surface 10. The one-trip system 250 comprises a coiled tubing cutter 300, such as the Cutting Overshot device sold by Thru-Tubing Technology, Inc. of Scott, La., and a wireline cutter 400 of the present invention, to be described in more detail herein. Both the coiled tubing cutter 300 and the wireline cutter 400 comprise tubular bodies configured to receive the upper end of the portion 155 of coiled tubing 150 that remains in the well 160. In the embodiment of FIG. 3, the wireline cutter 400 is the lowermost tool of the one-trip system 250, positioned downstream of the coiled tubing cutter 300. However, in another embodiment of the one-trip system 250, the positions of the coiled tubing cutter 300 and the wireline cutter 400 may be switched.

FIGS. 4-7 provide several cross-sectional and elevation views of one embodiment of a wireline cutter 400 comprising a primary tubular housing 410 and at least one modular tubular housing 420, with a blade 500 mounted internally of each housing 410, 420. The wireline cutter 400 is run into the well 160 with the blades 500 in the closed position shown FIGS. 4 and 5, and when the coiled tubing 150 is received into the wireline cutter 400, the coiled tubing 150 pushes the blades 500 to the open position shown in FIGS. 6 and 7

Figure 4:
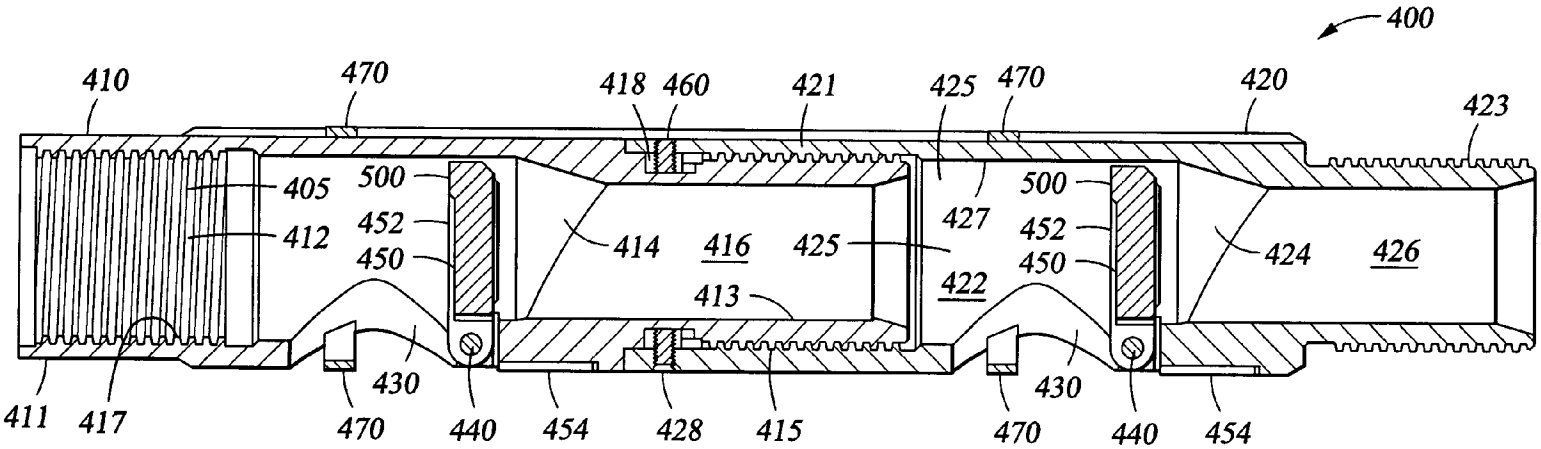
FIG. 4 is a cross-sectional elevation view of one embodiment of a wireline cutter, showing the blades in a closed, cutting position.
Figure 6:
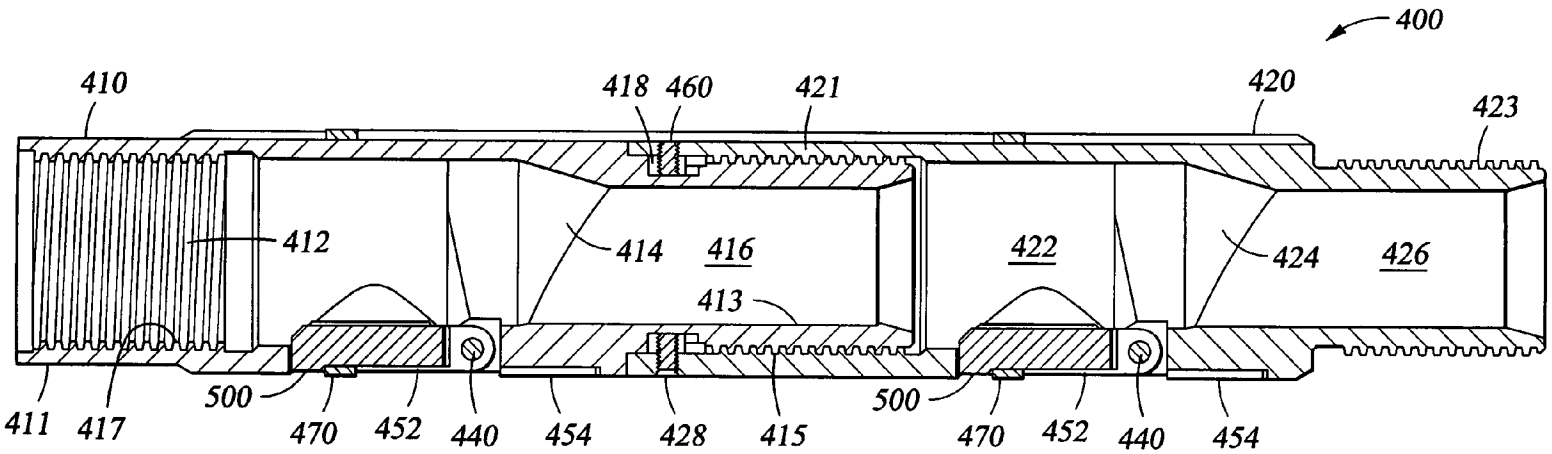
FIG. 6 is a cross-sectional elevation view of the wireline cutter of FIG. 4, showing the blades in an open position.

As best depicted in FIGS. 4 and 6, the primary housing 410 comprises a lower pin end 413 for connecting via threads 415 with the upper box end 421 of the modular housing 420. The primary housing 410 also comprises an upper pin end 411 for connecting to other components, such as the lower end of the coiled tubing cutter 300 or the work string 180. Likewise, the modular housing 420 comprises a lower pin end 423 for connecting to other components, including one or more additional modular housings 420, or the upper end of the coiled tubing cutter 300.

The primary housing 410 includes an axial bore 405 extending therethrough comprising a larger diameter bore 412 that reduces 414 to a smaller diameter bore 416. Similarly, the modular housing 420 includes an axial bore 425 extending therethrough comprising a larger diameter bore 422 that reduces 424 to a smaller diameter bore 426. The axial bores 405, 425 of the housings 410, 420 align to provide an axial throughbore in the wireline cutter 400.

The blades 500 are mounted via hinge pins 440 to the housings 410, 420. A torsional spring 450 wraps around each hinge pin 440, and one leg 452 of the spring 450 extends along the blade 500, while another leg 454 of the spring 450 extends axially along the respective housing 410, 420. The torsional springs 450 bias the blades 500 to the closed position shown in FIGS. 4 and 5, wherein the blades 500 extend radially across the axial bores 405, 425 of the housings 410, 420. The two legs 452, 454 of the spring 450 are positioned 90° apart when the blade 500 is in the closed position. When the coiled tubing 150 is received into the wireline cutter 400, the coiled tubing 150 rotates the blades 500 against the force of the torsional springs 450 to the open position shown in FIGS. 6 and 7. The two legs 452, 454 of the spring 450 are positioned 180° apart when the blade 500 is in the open position.

Figure 7:
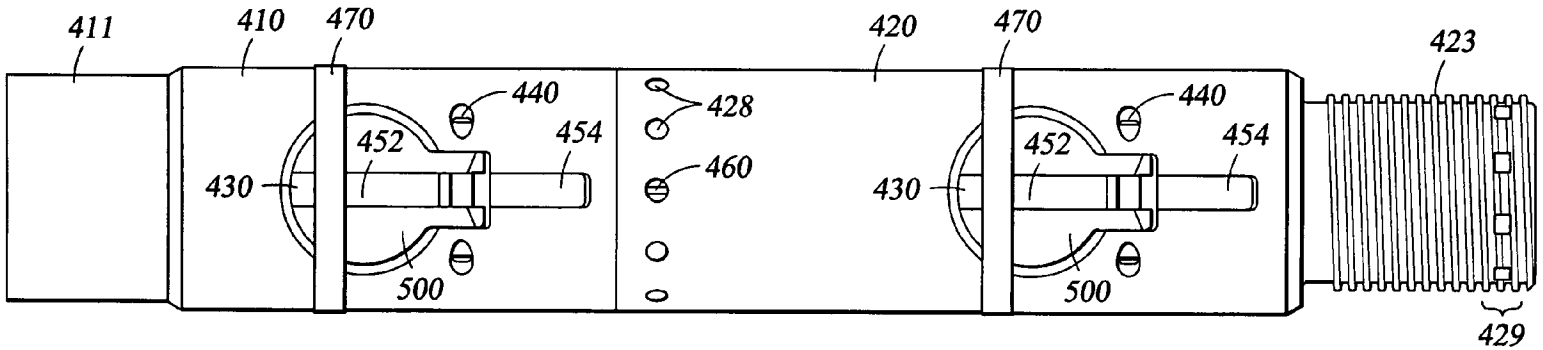
FIG. 7 is a side elevation view, from a different angle, of the wireline cutter of FIG. 4, showing the blades in the open position.
Figure 8:
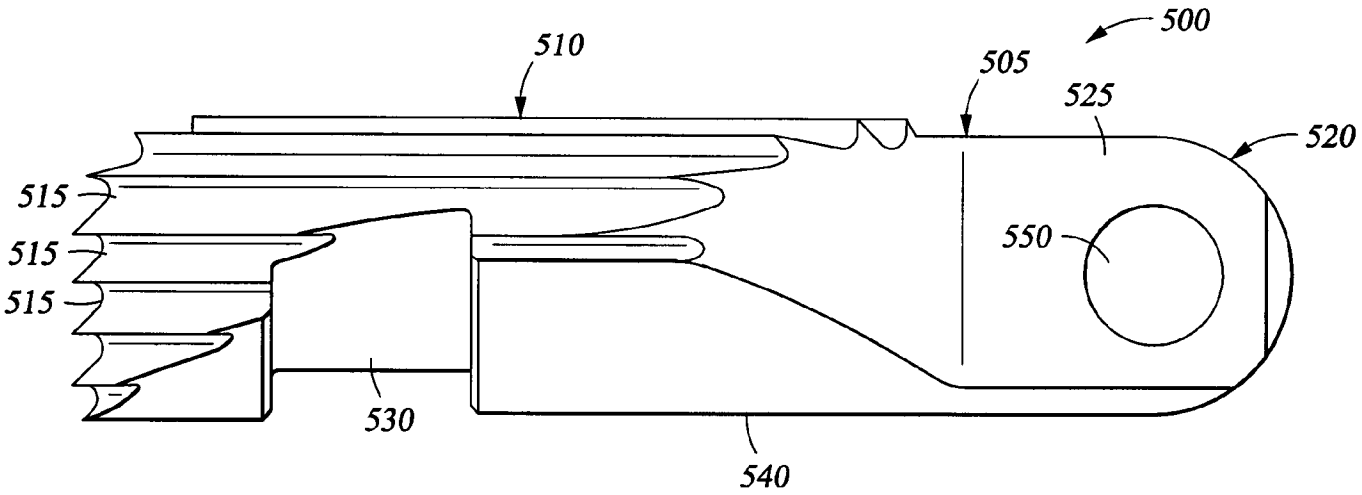
FIG. 8 is a side elevation view of one embodiment of a blade for the wireline cutter of FIG. 4.

In the embodiment shown in FIGS. 4-7, the minimum diameter of the axial bores 405, 425 must be large enough to receive the coiled tubing 150. In addition, the maximum outer diameter of the wireline cutter 400 must be small enough to fit within the well 160 and the deviated well bore 170. Further, the blades 500 must have a certain thickness to cut through the wireline 190, and the wall thickness of the housings 410, 420 must be adequate to receive a hinge pin 440 of sufficient strength to withstand the force exerted on the blades 500 when cutting the wireline 190. Therefore, certain features of the wireline cutter 400 are provided in response to such design constraints. For example, each of the housings 410, 420 comprises a cut-out portion 430 that provides a recess for the blades 500 in the open position shown in FIGS. 6 and 7. Thus, these cut-out portions 430 allow for storage of the blades 500 without interfering with the coiled tubing 150. In addition, to stop the blades 500 from rotating through the cut-out portions 430 into the well 160, retainer rings 470 are provided that wrap circumferentially about each housing 410, 420 and cross the cut-out portions 430. Thus, as best depicted in FIGS. 6 and 7, the retainer rings 470 provide a stop for the blades 500 when the coiled tubing 150 rotates the blades 500 to the open position.

In the configuration shown in FIGS. 4-7, the two blades 500 are in circumferential alignment. However, the primary housing 410 and the modular housing 420 are rotationally adjustable with respect to one another so that the two blades 500 may be circumferentially oriented in any desired position. In particular, the pin end 413 of the primary housing 410 includes a plurality of set screw sockets 418 that are set apart circumferentially, and the box end 421 of the modular housing 420 includes corresponding set screw bores 428. Thus, when making up the threaded connection 415, the housings 410, 420 may be rotated to any desired orientation so that the two blades 500 are set apart as desired. Then, one or more set screws 460 are installed into the set screw bores 428 to engage the corresponding set screw sockets 418, and thereby prevent the housings 410, 420 from rotating once they are set in the proper alignment. Accordingly, the housings 410, 420 may be rotationally adjusted to set the two blades 500 apart circumferentially, such as by 30°, 60°, or 90°, for example.

Further, because the lower housing 420 is modular, a plurality of modular housings 420 may be connected to one another to provide a longer wireline cutter 400 and additional blades 500 for cutting the wireline 190. Thus, these modular housings 420 may further comprise a plurality of set screw cavities 429 on the pin end 423 thereof corresponding to the set screw bores 428 on the box end 421 of the next modular housing 420 to be connected. Thus, the set screw cavities 429 and the corresponding set screw bores 428 provide rotational adjustability between two connected modular housings 420.

Accordingly, while the wireline cutter 400 depicted in FIGS. 4-7 includes two housings 410, 420 and two blades 500, in other embodiments, the wireline cutter 400 may comprise only the primary housing 410 with a single blade 500 mounted therein, or the wireline cutter 400 may comprise one or more modular housings 420 with blades 500 mounted therein.

Figure 9:
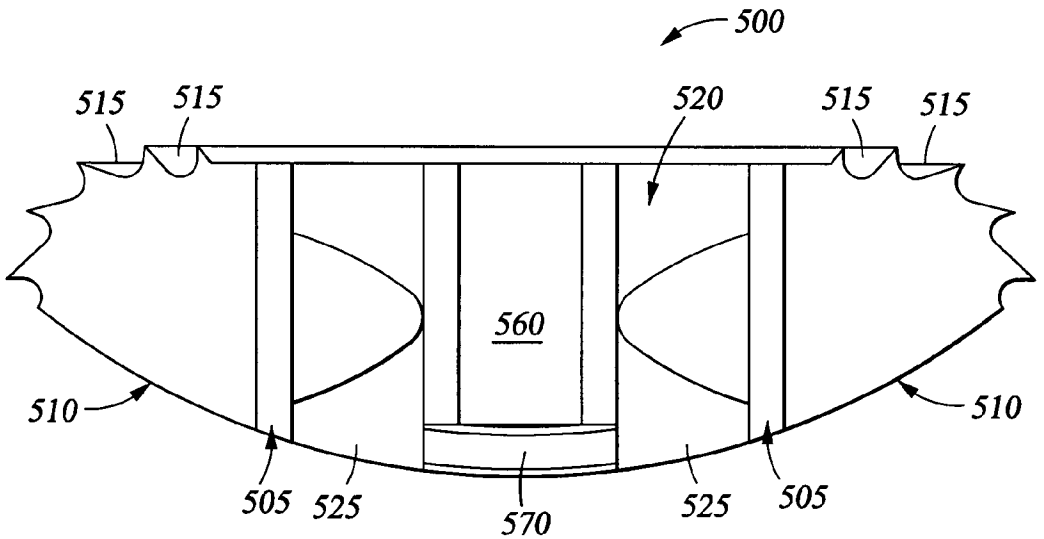
FIG. 9 is an elevation view of the blade of FIG. 8, viewed from the connection end.
Figure 10:
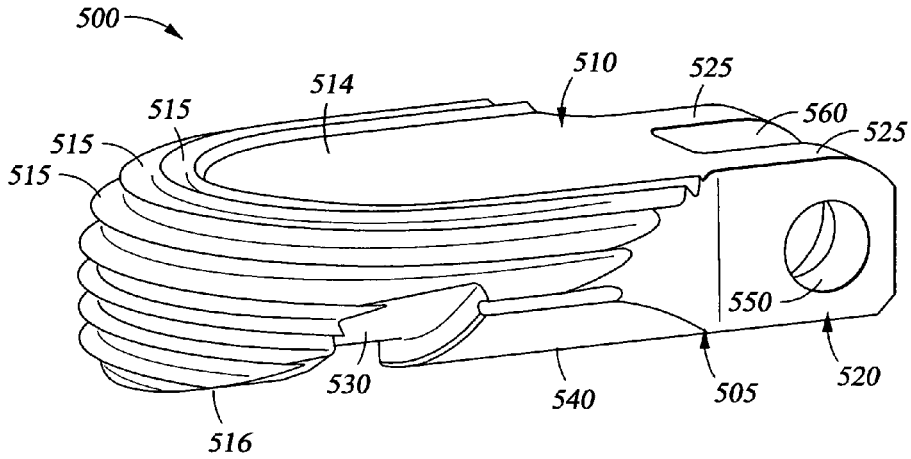
FIG. 10 is a perspective view of the blade of FIG. 8.
Figure 11:
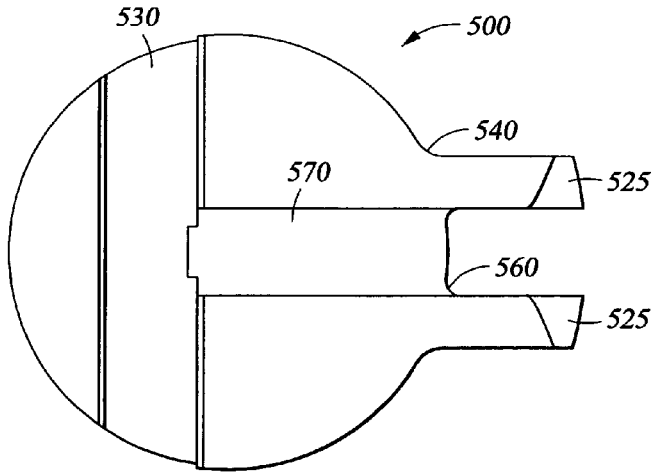
FIG. 11 is a plan view of one surface of the blade of FIG. 8.

Referring now to FIGS. 8-11, the blades 500 comprise a cutting portion 510, a transition portion 505, and a connection portion 520. The cutting portion 510 comprises teeth 515 operable to cut a wireline 190, or other umbilical, disposed within the coiled tubing 150. In one embodiment, the teeth 515 are also operable to grip the wireline 190 or other umbilical. The cutting portion 510 may be generally rounded, as best depicted in FIGS. 10 and 11, with the teeth 515 wrapping around the cutting portion 510 and tapering outwardly from a first surface 514 to a second surface 516. Thus, cutting teeth 515 are provided all the way around the cutting portion 510 to cut the wireline 190 regardless of its orientation within the wireline cutter 400.

As best shown in FIG. 11, the cutting portion 510 also comprises a tool-engaging surface 540 comprising a slot 530 to receive the retainer ring 470 when the blade 500 is in the open position, and a slot 570 to receive the torsional spring leg 452. Referring to FIGS. 9-11, the connection portion 520 comprises two lugs 525, each lug 525 including a bore 550 to receive the hinge pin 440. The lugs 525 are set apart to provide a gap 560 through which the hinge pin 440 extends. The portion of the torsional spring 450 that wraps around the hinge pin 440 is also positioned within this gap 560.

Figure 5:
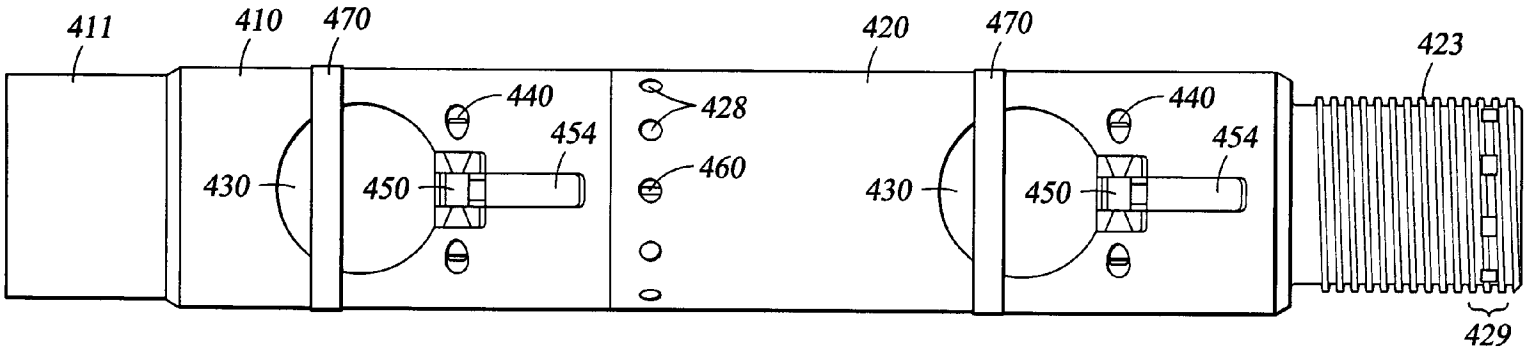
FIG. 5 is a side elevation view, from a different angle, of the wireline cutter of FIG. 4, showing the blades in the closed, cutting position.

In operation, when the one-trip cutting system 250 shown in FIG. 3 is run into the well 160, the blades 500 are biased to the closed position as shown in FIGS. 4-5. As the system 250 receives the coiled tubing 150, which runs up through the wireline cutter 400 and into the coiled tubing cutter 300, the coiled tubing 150 acts against the force of the torsional springs 450 to rotate the blades 500 to the open position shown in FIGS. 6-7. Then the coiled tubing cutter 300 is actuated to cut the portion 155 of coiled tubing 150, and the work string 180 is raised to release the coiled tubing 150 below the cut, thereby exposing the wireline 190 or other umbilical therein. Thus, the coiled tubing 150 will no longer extend through the wireline cutter 400 to hold the blades 500 open, and the blades 500 will close due to the biasing force of the springs 450.

As the blades 500 close, they push the wireline 190 against the internal walls 417, 427 of the housings 410, 420, and the angled transitions 414, 424 within both housings 410, 420 also help to direct the wireline 190 into position for cutting. When the wireline 190 is trapped by the blades 500 against the internal walls 417, 427, the teeth 515 grip the wireline 190, and the work string 180 is raised up with an adequate force to close the blades 500 even more to cut the wireline 190 with the teeth 515. Therefore, using the one-trip cutting system 250 comprising a coiled tubing cutter 300 and a wireline cutter 400, the coiled tubing 150 and the wireline 190 will be cut in the same general vicinity and fairly simultaneously, all in one trip into the well 160.

As previously described, because the wireline cutter 400 is a modular system, the operator can include as many or as few modular housings 420 as necessary to provide the desired number of blades 500 to cut the wireline 190. Therefore, the operator could elect to have only one blade 500 provided in the primary housing 410, or ten blades 500 provided in the primary housing 410 connected to nine modular housings 420, for example. Also, as previously described, the circumferential alignment of the blades 500 can be staggered by using the system of set screw slots 418 and cavities 429 with the set screw bores 428 that allow two housings 410, 420 to be rotationally adjusted as necessary. Thus, the operator may set the blades 500 at different angles circumferentially so that regardless of the position of the wireline 190 within the housings 410, 420, the wireline 190 will be captured and cut by one or more of the blades 500 that extend along the axial length of the wireline cutter 400. For example, if four blades 500 are provided, they could be positioned 90° apart from one another circumferentially.

In other operations, the wireline 190 may not be stuck, and the wireline cutter 400 may be used simply for retrieval purposes. For example, if the wireline 190 is very thick as compared to the wire size that the blades 500 are designed to cut, the blades 500 will tend to grip the wireline 190 without cutting it so that the wireline 190 may be pulled from the well 160. Whether or not the blades 500 will cut the wireline 190 depends upon the size of the wire and the pulling force applied to the work string 180.

In still other operations, a wireline 190 or other umbilical not associated with a coiled tubing string 150 may be stuck within a well 160. As one of ordinary skill in the art will readily appreciate, the wireline cutter 400 shown in FIGS. 4-7 may easily be modified to cut such a wireline 190 or other umbilical. In particular, in another embodiment, the wireline cutter 400 may comprise a mechanism, such as shear screws, for example, to retain the blades 500 in the open position during run-in. Then, once the wireline 190 or other umbilical is received within the wireline cutter 400, the retaining mechanism is removed so that the blades 500 close to cut the wireline 190. This alternative embodiment of the wireline cutter 400 can be run on the work string 180 without any other cutting tool.

The foregoing descriptions of specific embodiments of the wireline cutter 400, the one-trip cutting system 250, and the methods for cutting a wireline 190 or other umbilical have been presented for purposes of illustration and description and are not intended to be exhaustive or to limit the invention to the precise forms disclosed. Obviously many other modifications and variations are possible. In particular, the specific type and quantity of components that make up the wireline cutter 400 could be varied. For example, a different number of modular housings 420 with blades 500 disposed therein may be provided, including no modular housings 420. Further, the blades 500 may comprise a different design than the embodiments shown herein. In addition, the wireline cutter 400 may be used to cut other umbilicals besides a wireline 190.

While various embodiments of the wireline cutter 400 and the one-trip cutting system 250 have been shown and described herein, modifications may be made by one skilled in the art without departing from the spirit and the teachings of the invention. The embodiments described are exemplary only, and are not intended to be limiting. Many variations, combinations, and modifications of the device and methods disclosed herein are possible and are within the scope of the invention. Accordingly, the scope of protection is not limited by the description set out above, but is defined by the claims which follow, that scope including all equivalents of the subject matter of the claims.

What we claim as our invention is:

1. A wireline cutter comprising:

a primary housing with a first axial configured to receive a wireline positioned within a well bore;

a first blade having a connection end pivotally mounted to the primary housing and operable to cut the wireline one or more modular housings;

wherein each of the one or more modular housings comprises:

another axial bore configured to receive the wireline; and another blade mounted within the modular housing and operable to cut the wireline.

2. The wireline cutter of claim 1 wherein the first blade comprises teeth operable to grip and cut the wireline.

3. The wireline cutter of claim 1 further comprising a torsional spring.

4. The wireline cutter of claim 3 wherein the spring biases the first blade to a closed position extending radially across the first axial bore.

5. The wireline cutter of claim 4 wherein the first blade cuts the wireline in the closed position.

6. The wireline cutter of claim 1 wherein one or more of the another blades is substantially identical to the first blade.

7. The wireline cutter of claim 1 further comprising:

a plurality of set screw sockets disposed in a wall of the primary housing; and a plurality of set screw bores disposed in a wall of each of the one or more modular housings;

wherein the set screw sockets are spaced apart circumferentially; and wherein the set screw bores are spaced apart circumferentially to correspond with the spacing of the set screw sockets.

8. The wireline cutter of claim 7 wherein the set screw sockets and the set screw bores enable rotational adjustability when connecting the primary housing and a modular housing.

9. The wireline cutter of claim 7 further comprising a plurality of set screw cavities disposed in the wall of each of the one or more modular housings.

10. The wireline cutter of claim 9 wherein the set screw cavities and the set screw bores in each of the modular housings enable rotational adjustability when connecting two modular housings.

11. The wireline cutter of claim 1:

wherein the primary housing is further configured to receive an umbilical positioned within the well bore; and wherein the first blade is operable to cut the umbilical.

* * * * *